US005787684A

United States Patent [19]

Compton

[11] Patent Number: 5,787,684

[45] Date of Patent: Aug. 4, 1998

[54] MULTIPLE PACK OF INDIVIDUALLY PACKAGED ITEMS, METHOD AND APPARATUS FOR PRODUCING SAME

[75] Inventor: Peter Arnold Compton, Melton Mowbray, United Kingdom

[73] Assignee: Mars UK Limited, Berkshire, United Kingdom

[21] Appl. No.: 957,395

[22] Filed: Oct. 23, 1997

Related U.S. Application Data

[63] Continuation of Ser. No. 428,081, filed as PCT/GB93/02239, Nov. 11, 1993, abandoned.

[30] Foreign Application Priority Data

Oct. 30, 1992 [GB] United Kingdom ..... 92 22829

[51] Int. Cl.[6] ..... B65B 35/30

[52] U.S. Cl. ..... 53/448; 53/398; 53/449

[58] Field of Search ..... 53/48.1, 171, 398, 53/448, 449, 543; 206/427, 431, 460, 813

[56] References Cited

U.S. PATENT DOCUMENTS

| | | | |
|---|---|---|---|
| 2,677,460 | 5/1954 | Johnson et al. | 53/48.1 X |
| 3,055,497 | 9/1962 | Brunsing . | |
| 3,094,210 | 6/1963 | Van Den Berg | 53/48.1 X |
| 3,137,109 | 6/1964 | Rapata | 53/48.1 X |
| 3,851,762 | 12/1974 | Liblick . | |
| 3,864,895 | 2/1975 | Petrea . | |
| 3,924,739 | 12/1975 | Gravesteijn | 206/460 X |
| 4,256,526 | 3/1981 | McDaniel | 53/383.1 X |
| 4,263,769 | 4/1981 | Hanazawa et al. | 53/448 |
| 4,436,205 | 3/1984 | Horii | 206/460 X |
| 4,441,611 | 4/1984 | Sommariva | 206/460 X |
| 5,099,632 | 3/1992 | Klygis et al. | 53/398 |

FOREIGN PATENT DOCUMENTS

| | | | |
|---|---|---|---|
| 0060504 | 9/1982 | European Pat. Off. . | |
| 0 368 714 | 5/1990 | European Pat. Off. . | |
| 2836533 | 2/1980 | Germany | 206/460 |
| 2931118 | 2/1980 | Germany . | |
| 2837659 | 3/1980 | Germany | 206/460 |
| 602431 | 7/1978 | Switzerland . | |
| 2 136 760 | 9/1984 | United Kingdom . | |
| 2 150 908 | 7/1985 | United Kingdom . | |

*Primary Examiner*—Daniel Moon
*Attorney, Agent, or Firm*—Leonard J. Santisi

[57] ABSTRACT

A multiple pack of individually packaged items comprises an array of individual packages in a desired configuration which array is held in the desired configuration by a planar sheet material adhered to each package of the array. The planar sheet material is preferably a sheet of corrugated cardboard. The invention also includes a method of forming the multiple pack and apparatus for use.

7 Claims, No Drawings

MULTIPLE PACK OF INDIVIDUALLY PACKAGED ITEMS, METHOD AND APPARATUS FOR PRODUCING SAME

This application is a continuation of application Ser. No. 08/428,081, filed Jul. 28, 1995 now abandoned, which is a 371 of PCT/GB93/02239 Nov. 11, 1993.

FIELD OF THE INVENTION

This invention relates to packaging and more particularly to packaging of the type for producing a "carry-home" pack of a number of filled containers of for example, beverage or food.

DESCRIPTION OF THE RELATED ART

In recent years for ease of carriage and/or for promotional purposes it has become the custom to package containers, for example of drink and/or food in multiples, frequently in fours or sixes, although the number is immaterial.

Numerous methods are known for assembling such packages.

Packages, have for example, been assembled by shrink wrapping in a sleeve of, for example, polyethylene.

The so called "Hi-Cone" system has also been used. This comprises an apertured sheet of polyethylene. The top parts of the cans are placed into circular apertures in the film which then grips the cans below their upper rim. More recently a further form of packaging, particular for cans of drink has been developed which completely covers the top of the can and comprises a sheet of polyester film which on application is molded around the top of an assembly of cans to grip the individual cans around their top rim.

All round or partial wrap round cardboard packaging is also known, especially for drinks.

All of these forms of packaging are effective in their own way but most are expensive, particularly when the packaging is intended to convey promotional messages.

SUMMARY AND OBJECTS OF THE INVENTION

According to the invention a multiple pack of individually packaged items is produced by assembling an array of individual packages in a desired orientation, applying to each package of the said array an adhesive material and adhering to the packages by means of the adhesive a planar sheet material such that the assembly is sufficiently strongly held together to allow carriage but the individual packages can be readily pulled off the sheet for use.

DETAILED DESCRIPTION OF CERTAIN PREFERRED EMBODIMENTS

In accordance therewith, the adhesive bond may be such as to allow rupture at the interface either with the package or with the sheet material but, in order to obtain adequate bond strength will normally be such that the act of removing a package from the sheet material will result in removal also of a portion of the sheet material.

The invention is primarily applicable to canned products but it can also be applied to any other packaged products. It may be, for example, used for the production of multiple packs of product in disposable bottles or jars or even for products in cardboard packaging.

The planar sheet material is preferably a cellulose based material, especially cardboard and, more preferably, corrugated cardboard, primarily because this material is cheap and easy to dispose of and when used in the method of the invention does not require any special coating or strengthening treatment. Moreover, a far smaller amount of material is used compared with wrap round packs.

The surface of the sheet material may carry bar coded information, promotional material or any other message, if desired and the invention provides an extremely cost effective way of providing the dual functions of collation of a multiple pack and delivery of promotional messages.

The planar material may be provided with cut-outs, apertures or other features to facilitate carrying.

The adhesive used is preferably a hot melt type adhesive, preferably a moisture curing polyurethane based hot melt adhesive, such as the adhesives marketed by Natural Starch & Chemical Limited under the trademark Pur-fect.

Depending on the shape of the individual packages, the adhesive may be applied in any desired orientation or position. For some packages it may be desirable to have a single large area of adhesive on each package while for others it may be necessary or desirable to have a plurality of smaller areas of adhesive.

Adhesives that have been foamed, e.g. by gaseous injection, may be used, especially when the adhesive is to be applied on an irregular surface, e.g. a recessed surface, since the expansion of the adhesive will fill any voids in a cost effective manner with minimum use of adhesive. A unique advantage of foamed adhesive in the invention is that when in the foamed state the set is delayed because of the insulating nature of the foam but when the foam has been collapsed by application of the sheet material setting is substantially instantaneous.

Although, as mentioned above multiple packs of, for example, canned foods and/or drinks are normally fours or sixes it is possible according to the invention, even when wishing to assemble multiple packs of this size, to apply a large sheet over a very much larger array of packages with subsequent splitting up of the larger array into individually multipack units. This is not generally possible with other methods of producing multipacks.

Such a method of operation makes it possible to operate in a continuous manner by feeding continuous sheet material to a continuously advancing array of packages to which adhesive has been applied, with consequent splitting into smaller units of desired size. Continuous operation is again not generally possible with other methods of producing multipacks.

The invention also provides a multipack of individually packaged items commprising an array of individual packages, said array being held together by a planar sheet material adhered to each package of the array.

The invention further provides apparatus for producing multiple packs of individually packaged items comprising means for collating an array of individual packages in a desired configuration, means for applying to each of said individual packages an adhesive material in an identical position or positions on each package means for supplying planar sheet material of such area as to cover the entire adhesive area of the array of packages and for bringing said planar material into contact with the adhesive on the individual packages.

What is claimed is:

1. A method for producing a finished multiple pack of individually packaged items comprising the steps of:

assembling an array of individual packages in a desired orientation; and applying to each package of the array a foamed adhesive material and collapsing the foamed adhesive material by adhering a planar sheet material to the packages by means of the foamed adhesive material over one face only of the array to set the foamed adhesive substantially instantaneously wherein the array is held together for carrying but the individual packages can be removed from the planar sheet material for use.

2. A method according to claim 1 wherein the foamed adhesive provides for removal of a package and removal of a portion of the planar sheet material.

3. A method according to claim 1 wherein the planar sheet material is a cellulose based material.

4. A method according to claim 1, wherein the planar sheet material is corrugated cardboard.

5. A method according to claim 1 which further comprises:

forming an array of packages larger than is intended for the finished multiple pack;

applying a single planar sheet material over the entire array; and subsequently cutting the planar sheet material to provide multiple packages of the desired number of packages.

6. A method according to claim 5 which is carried out continuously by applying large sheets of planar material to a continuously advancing array of packages.

7. A method according to claim 5 which is carried out continuously by applying continuous planar material to a continuously advancing array of packages.

* * * * *